US008375641B2

(12) United States Patent
Lundahl

(10) Patent No.: US 8,375,641 B2
(45) **Date of Patent: *Feb. 19, 2013**

(54) COIL SPRING COUNTERBALANCE

(75) Inventor: Dave B. Lundahl, Fort Collins, CO (US)

(73) Assignee: Inovadeas, LLLP, Fort Collins, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/422,633

(22) Filed: Mar. 16, 2012

(65) Prior Publication Data

US 2012/0180399 A1 Jul. 19, 2012

Related U.S. Application Data

(60) Division of application No. 12/410,296, filed on Mar. 24, 2009, now Pat. No. 8,136,301, which is a continuation-in-part of application No. 11/428,937, filed on Jul. 6, 2006, now Pat. No. 7,506,475, which is a continuation-in-part of application No. 11/419,702, filed on May 22, 2006, now abandoned, which is a continuation of application No. 10/990,639, filed on Nov. 16, 2004, now Pat. No. 7,047,693.

(60) Provisional application No. 60/530,113, filed on Dec. 17, 2003.

(51) Int. Cl.
*E06B 3/00* (2006.01)

(52) U.S. Cl. ..... 49/506; 49/448

(58) Field of Classification Search ..... 49/445, 49/446, 447, 448, 176, 506; 16/197, 400, 16/401

See application file for complete search history.

(56) References Cited

U.S. PATENT DOCUMENTS

| | | | | |
|---|---|---|---|---|
| 2,262,990 | A * | 11/1941 | Cross et al. | 16/197 |
| 4,935,987 | A * | 6/1990 | Sterner, Jr. | 16/198 |
| 6,606,761 | B2 * | 8/2003 | Braid et al. | 16/197 |
| 7,047,693 | B2 * | 5/2006 | Lundahl | 49/447 |
| 7,506,475 | B2 * | 3/2009 | Lundahl | 49/506 |
| 7,552,510 | B2 * | 6/2009 | Harold et al. | 16/197 |
| 8,136,301 | B2 * | 3/2012 | Lundahl | 49/447 |

* cited by examiner

*Primary Examiner* — Jerry Redman

(74) *Attorney, Agent, or Firm* — Samuel M. Freund; Cochran Freund & Young LLC

(57) ABSTRACT

Disclosed is a pivotable, multi-coil spring counterbalance, and method for using the same, which allows the user to readily attach a desired number of coil springs having chosen forces to a counterbalance connector attached to a vertically movable member, thereby providing an offset for at least a portion of the weight thereof.

5 Claims, 18 Drawing Sheets

COIL SPRING COUNTERBALANCE

CROSS REFERENCE TO RELATED APPLICATIONS

The present patent application is a Divisional of patent application Ser. No. 12/410,296 filed Mar. 24, 2009, which issued as U.S. Pat. No. 8,136,301 on Mar. 20, 2012, which is a continuation-in-part application of 11/458,937, filed Jul. 6, 2006, issued U.S. Pat. No. 7,506,475 for "Multi-Coil Spring Window Counterbalance Assembly" which issued to Dave B. Lundahl on Mar. 24, 2009 which is a continuation-in-part application of U.S. patent application Ser. No. 11/419,702 entitled "Multi-Coil Spring Window Counterbalance" by Dave B. Lundahl filed on May 22, 2006, which is a continuation of 10/990,639 filed Nov. 16, 2004 now U.S. Pat. No. 7,047,693, for "Multi-Coil Spring Window Counterbalance" by Dave B. Lundahl, which claims the benefit of U.S. Provisional Patent Application Ser. No. 60/530,113 entitled "Multi-Coil Spring Window Counterbalance" by Dave B. Lundahl filed on Dec. 17, 2003, the entire contents of said applications and patents hereby being specifically incorporated by reference herein for all that they disclose and teach.

FIELD OF THE INVENTION

The present invention relates generally to vertically movable members and, more particularly, to a counterbalance device for offsetting at least a portion of the weight of a vertically movable member.

BACKGROUND OF THE INVENTION

Counterbalance mechanisms have been used for vertically sliding window sashes for a substantial period of time. Weights connected over a pulley to the window sash by ropes, cords, ribbons, bands, chains, and the like ("connectors") provide sufficient upward force on the sash that the weight thereof is counterbalanced and the sash can easily be lifted and maintained in a stationary position.

Problems exist with such counterbalancing mechanisms. For example, the connector may break, thereby rendering the counterbalance mechanism ineffective. If the connector breaks when the sash is in the closed position and the weight is sufficiently heavy, the weight can fall through the weight pocket, break through the bottom of the window frame and pass into the wall. Fixing such systems may be difficult since counterbalances having a desired weight which are capable of fitting through the opening of the weight pocket may not be readily available.

If the window glass is broken, a lighter or heavier glass may be used to replace the broken glass which, in turn, will cause the original counterbalance weight to improperly counterbalance the new weight of the sash. The force generated by prior art counterbalance devices cannot readily be adjusted for a particular sash in a weight and pulley vertically operating window counterbalance system.

Replacement of broken ropes or chains may also be difficult, since heavy counterbalance weights may have to be assembled when repair is attempted. Further, with heavy sashes, counterbalance weights sometimes require a diameter that is too large to fit into the opening of the window frame to provide sufficient counterbalance weight. If the necessary counterbalance weight is achieved by using a weight having a smaller diameter, it will necessarily be longer to be of an adequate and effective weight to counterbalance a heavy sash. Such longer weights significantly reduce the amount of travel of the sash because the longer weight will more readily contact the bottom of the window frame.

SUMMARY OF THE INVENTION

Accordingly, it is an object of the present invention to provide an adjustable counterbalance system.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects, and in accordance with the purposes of the present invention, as embodied and broadly described herein, the counterbalance apparatus, hereof, includes in combination: a mounting member having an open channel; a pivot member rotatably mounted in the open channel of the mounting member; at least one coil spring mounted on the pivot member such that the at least one coil spring can be uncoiled from the pivot member, thereby generating a chosen force; a counterbalance connector having a first end and a second end; at least one second connector for attaching at least one of the at least one coil springs to the first end of the counterbalance connector such that a desired force is generated at the second end of the counterbalance connector; whereby the pivot member can be rotated into and out of the open channel of the mounting member.

In another aspect of the present invention and in accordance with its objects and purposes, the method for counterbalancing at least a portion of the weight of a vertically movable member, hereof, includes: mounting at least one coil spring on a pivot member such that each of the at least one coil springs generates a chosen force when uncoiled from the pivot member; pivotably mounting the pivot member in a mounting member having an open channel, thereby permitting the at least one coil spring to be readily accessed; and attaching a chosen number of the at least one coil springs to a counterbalance connector such that a selected force is exerted on the counterbalance connector; and attaching the counterbalance connector to the vertically movable member such that at least a portion of the weight of the vertically movable member is offset.

Benefits and advantages of embodiments of the present invention include, but are not limited to, the ability to select a desired force by choosing a combination of coil spring strength and the number of coil springs that are attached to the counterbalance connector. In the situation where the coil spring counterbalance apparatus is used to compensate for at least a portion of the weight of a vertically movable member, for example, a window sash, the coil spring counterbalance apparatus may be located in a weight pocket of a window frame from which the pivoting portion thereof may readily be rotated to an accessible, open position such that the counterbalance connector may be conveniently connected with hooks or other fasteners to the chosen number of coil springs, and servicing may be performed by a single individual. Additionally, the apparatus may be recessed within the weight pocket whereby the window retains an aesthetic appearance while maintaining its functionality. Since each spring may provide a constant, predetermined force, for example, between 3 pounds and 10 pounds, the springs may safely be attached one at a time.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings:

FIG. 7A is a schematic representation of the top view of the mounting block for the pivot member/multi-coil spring holder of the present invention, while FIG. 7D is a schematic representation of a projection view of the mounting block and the multi-coil spring assembly shown in FIG. 7C hereof, while

FIG. 10A is a schematic representation of an exploded view of an embodiment of the multi-coil spring holder of the multi-coil spring assembly of the present invention, while

DETAILED DESCRIPTION OF THE INVENTION

Briefly, the present invention includes a coil spring counterbalance for at least partially compensating for the weight of a vertically movable member, such as a window sash, a door or a garage door, as examples, and a method for using the same. Each coil spring may have multiple coils, and the terms coil spring and multi-coil spring are interchangeably used throughout. Several embodiments of the coil spring counterbalance bearing at least one coil spring are described. The use of an embodiment of the invention as a counterbalance for a sash in a vertically operating window is described in detail. Existing vertically operating windows can readily be retrofit with the present invention, and new windows can be constructed using the present invention. The present invention allows the counterbalance connector to be attached to the coil spring assembly in a straightforward manner which includes rotating the coil spring assembly to the interior sash channel portion of the window. The desired counterbalance force can be selected by attaching a chosen combination of coil spring strength and number of coil springs to the connector which allows the user to select the desired amount of counterbalance force. The coil spring assembly is pivotably mounted in a mounting block which is inserted through the weight pocket access opening and mounted to the back inner vertical wall of the weight pocket as a single unit. No modification of the weight pocket or window frame need be made.

The present invention overcomes the disadvantages and limitations of the prior art by providing a coil spring assembly that can easily be installed in new windows or retrofitted into older windows, and provides an adjustable counterbalance force suitable for different size windows. In addition, the present invention provides a safe, simple and easy-to-use system for attaching a desired number of coil springs to the connector used in a pulley and weight counterbalance system.

Figure 1:
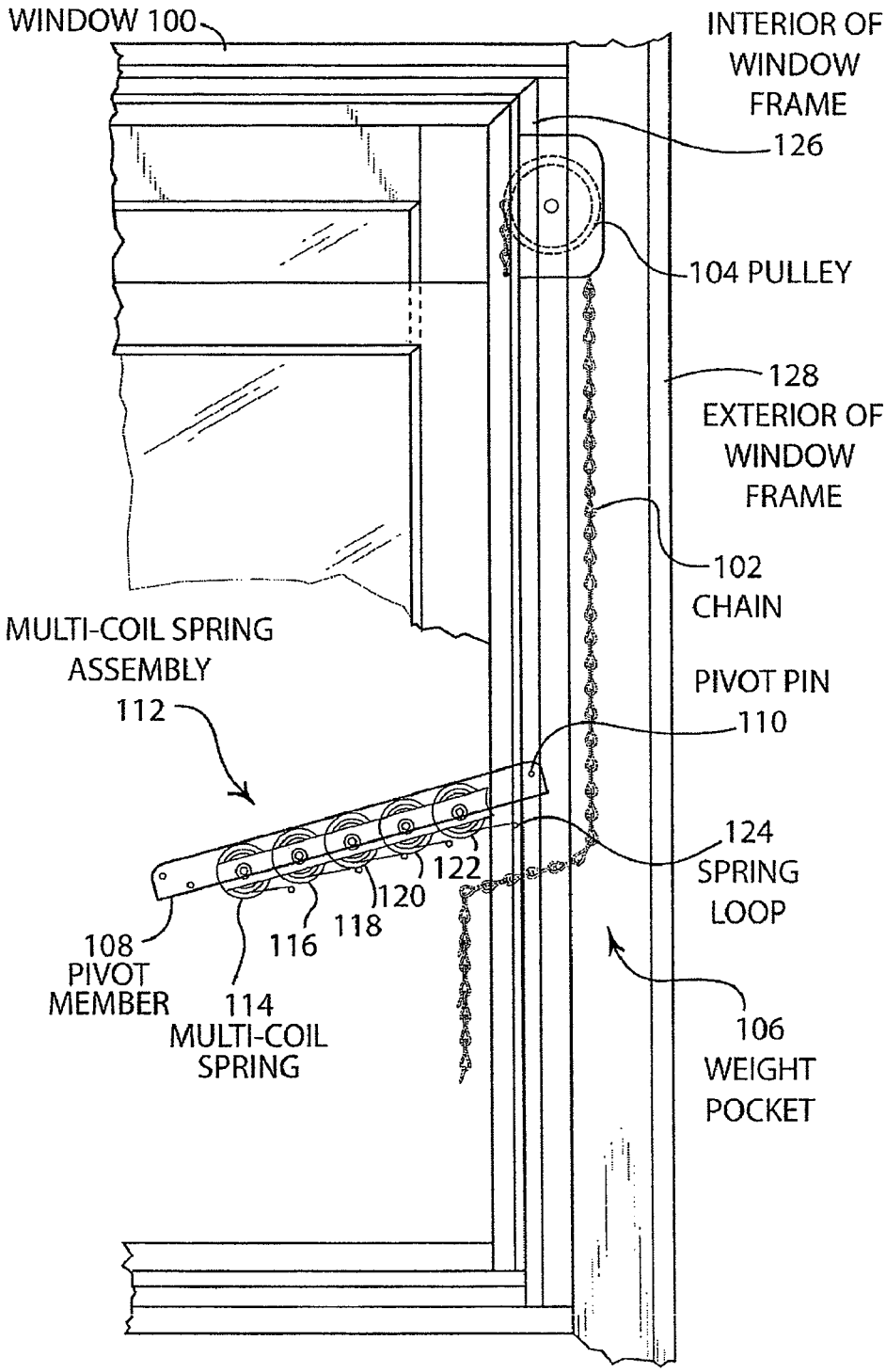
FIG. 1 is a schematic representation of a front cut-away view of one embodiment of the present invention, illustrating the pivot member/multi-coil spring assembly, the connector, the pulley, and the sash.

Reference will now be made in detail to the present preferred embodiments of the inventions, examples of which are illustrated in the accompanying drawings. In the FIGURES, similar structure will be identified using identical reference characters. Turning now to FIG. 1, shown is a schematic representation of a front view of window, 100, looking out from the inside of a room, in which coil spring window counterbalance assembly, 112, is mounted. As illustrated, each spring may have multiple coils. Coil spring assembly 112 is mounted in the frame of window 100 by pivot pin, 110, and is shown pivoted inwardly into the area vacated by the sash when the sash is in an open position; that is, towards the interior of window 100. Connector, 102, is attached to the top portion of the sash of vertically operating window 100 (not shown in FIG. 1) after passing around pulley, 104. Connector 102 and pulley 104 are mounted in weight pocket, 106, of the vertically operating window. The weight pocket is a space provided between exterior portion, 128, of the window frame and interior portion, 126, thereof that houses the lead or steel counterbalance weights and the pulley apparatus of traditional counterbalance systems.

Coil spring assembly 112 includes at least one multi-coil spring, 114, 116, 118, 120, and 122, mounted on pivot member, 108. Multi-coil springs 114-122 may be mounted and selected such that each of the coil springs generates a substantially constant, chosen spring force when attached to connector 102, as will be described hereinbelow. Pivot member 108 is mounted in the interior portion of window frame 126 using pivot pin 110 which permits pivot member 108 to swivel, as shown in FIG. 1, into the sash channel area (interior portion 126) of the window 100, as described above. With the bracket pivoted into the sash channel area of the window, connector 102, shown as a chain, can be connected and disconnected to coil springs 114-122 in a straightforward and easy manner. Spring loop, 124, is used to attach each of coil springs 114-122 to chain 102, as desired, and as described in more detail hereinbelow. As indicated hereinabove, multi-coil springs 114-122 each may provide a substantially constant force that is cumulative as each spring is attached to chain 102. For example, each coil spring may be selected to provide a constant counterbalance force of between one and ten pounds which may be varied in one pound increments between coil springs. Pivot member 108 can contain any desired number of coil springs, such as the five coil springs, 114-122 shown in FIG. 1A hereof. A user may select the amount of force that is needed to adequately and accurately counterbalance the weight of the sash by selecting the optimum combination of coil spring strength and number of coil springs so that the window may readily be raised and lowered. While selection of the number and force of the multi-coil springs permits a close matching of counterbalance force to the weight of the sash, the remaining difference may be accommodated by the friction created between the sash and window frame. The number of coil springs can be pre-calculated by determining the weight of the sash and attaching the number of coil springs having the cumulative amount of force that closely matches the weight of the window sash. Alternatively, this process can be performed empirically by attaching a fewer or greater number of coil springs until the optimum operational characteristics are achieved. Since coil springs 114-122 can readily be attached or disconnected from chain 102, such trial and error method can be easily performed.

Figure 2:
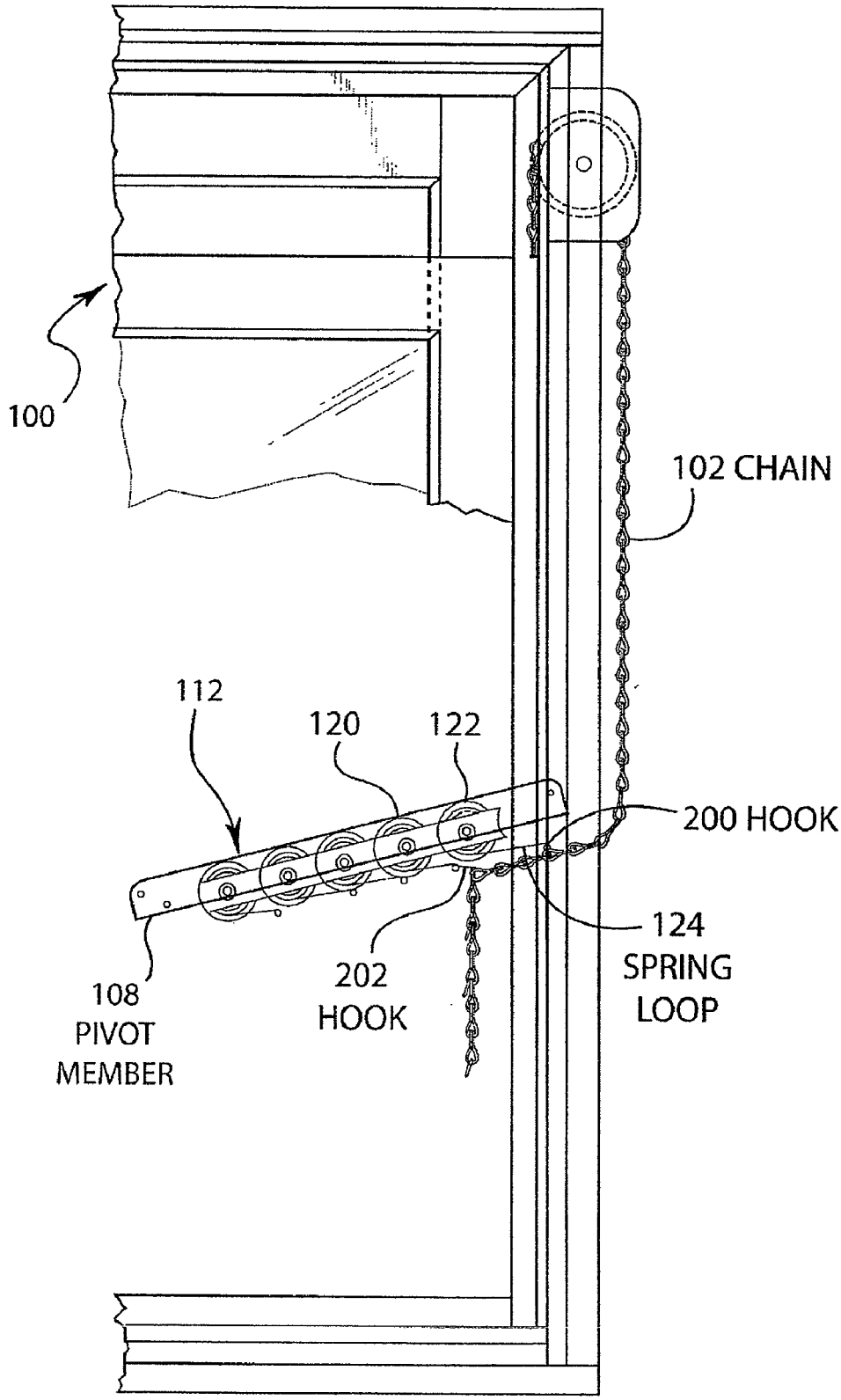
FIG. 2 is a schematic representation of a front cut-away view of the embodiment of the invention shown in FIG. 1 hereof further illustrating the attachment of a single multi-coil spring to the connector, one spring at a time.

FIG. 2 is a schematic representation of the front view of window 100 shown in FIG. 1 hereof, in which coil spring window counterbalance assembly 112 is mounted, further illustrating multi-coil spring 122 being attached to chain 102 using hook, 200. In a similar manner, multi-coil spring 120 is attached to chain 102 using hook, 202. Hooks 200 and 202 are designed for easy attachment and disconnection from chain 102, since each of the multi-coil springs 120 and 122 provide a pre-determined force that is sufficiently low to allow the user to easily uncoil the multi-coil spring element outward from the coil so that the hooks can be easily attached to or disconnected from chain 102 without danger to the user. The hooks are also designed with sufficient retainer portions to prevent unintentional disengagement from the chain and spring coil. Hook 200 may attach to any desired portion of the chain to which the hook can engage the chain. Hook 200 also attaches to spring loop 124 of coil 122 at the opposing end of the hook. Each of coils 114-120 has a similar spring loop which is adapted to engage the hooks.

Figure 3:
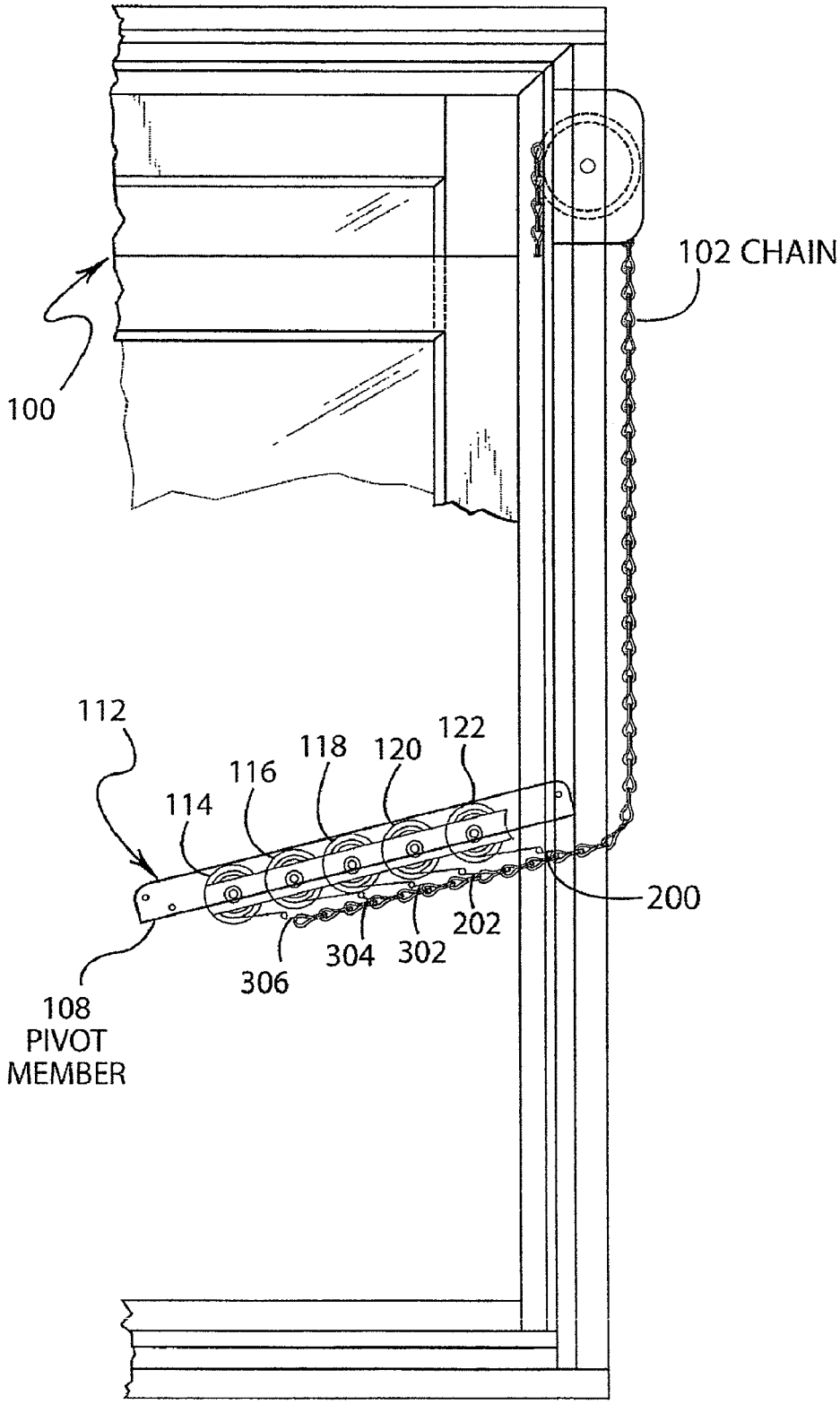
FIG. 3 is a schematic representation of a front cut-away view of the embodiment of the invention shown in FIG. 1 hereof further illustrating the attachment of multiple multi-coil springs to the connector.

FIG. 3 is a schematic representation of the front view of window 100 shown in FIG. 1 hereof, in which coil spring window counterbalance assembly 112 is mounted, further illustrating each of coil springs 114-122 being attached to the chain 102, hooks 200, 202, 302, 304, and 306 connecting coil springs 122, 120, 118, 116, and 114, respectively, to chain 102. Hence, the downward force generated on chain 102 when multi-coil springs 114-122 are engaged is the cumulative force of each of the coil springs 114-122. For example, if each of the multi-coil springs 114-122 provides a force of 8 pounds, the cumulative force on chain 102 for the 5 springs is 40 pounds. Further, if a pulling force of 35 pounds is desired, it can be achieved with the selection of four coil springs, each creating 8 pounds of pulling force, and one coil spring having 3 pounds of pulling force. In other words, each of the coils can be selected to provide a specific amount of force to create a desired total force. In this fashion, the desired total force can be generated on chain 102 by attaching the desired number of coil springs to the chain and selecting the coil springs with a specified amount of pulling force.

Figure 4:
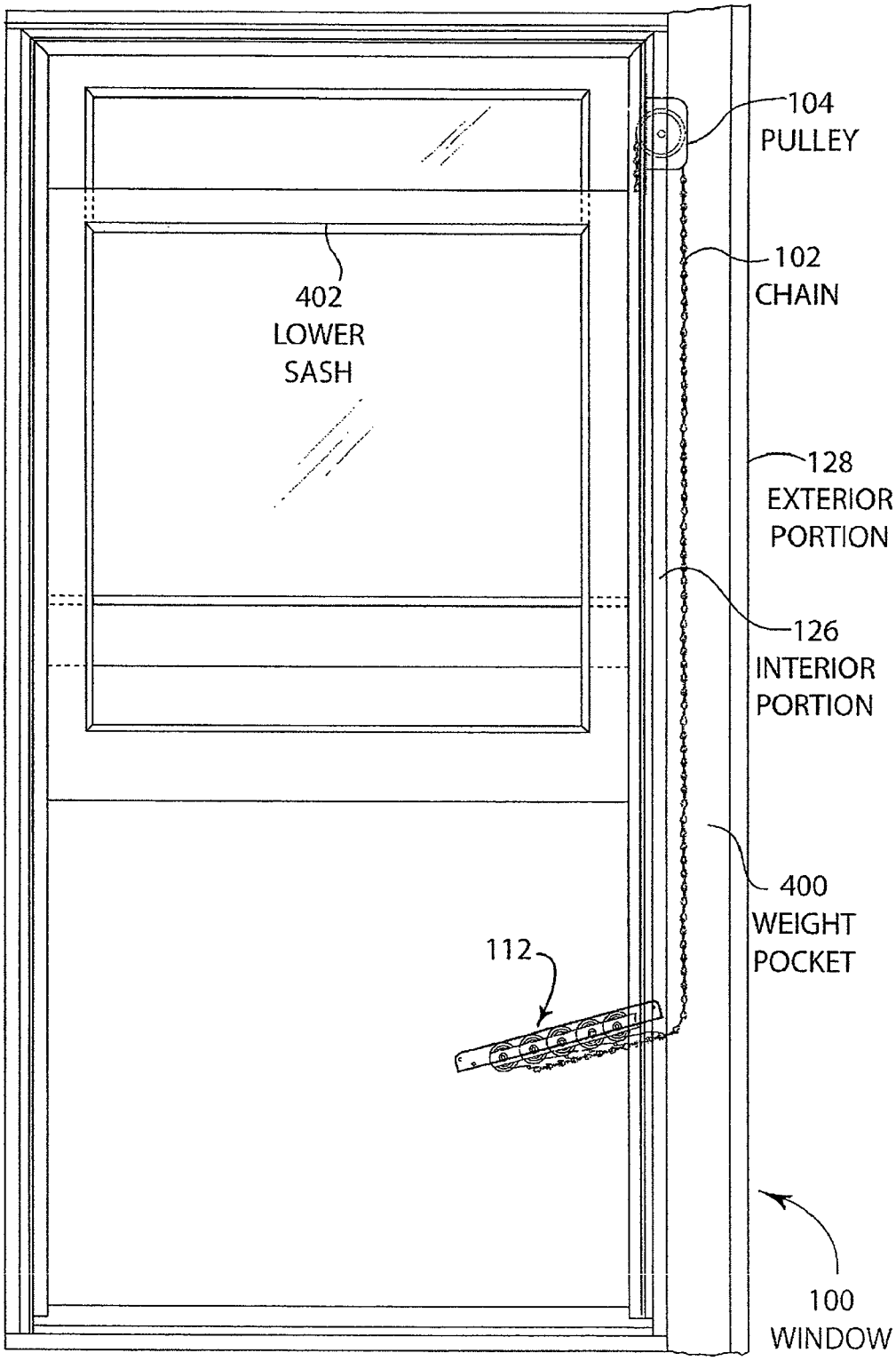
FIG. 4 is a schematic representation of a more complete front cut-away view of the embodiment of the invention shown in FIG. 1 hereof further illustrating the attachment of multiple multi-coil springs to the connector, the pivot member/multi-coil spring assembly in its accessible position, and the lower sash in an open position.

FIG. 4 is a schematic representation of the front view of window 100 shown in FIG. 1 hereof, further illustrating the entire window frame. Chain 102 is disposed in weight pocket, 400 which is formed between exterior portion, 128, and interior portion, 126, of the window frame. Chain 102 is disposed substantially vertically in weight pocket 400, around pulley 104 and is attached to sash 402. The other end of the chain is attached to multi-coil spring assembly 112 which is shown as pivoted inwardly into the sash channel interior portion of window 100, for ready access to chain 102 and to the coil springs.

It should be mentioned that although the present invention is described in terms of a single multi-coil spring assembly, pulley, chain and weight pocket, there is a weight pocket formed in the opposite side of the frame from weight pocket 400 bearing a similar counterbalance apparatus as that described hereinabove (not shown in FIG. 4). This permits the sash to have substantially similar forces supporting it on each side, thereby preventing binding of the sash in the sash guide. As will be described in more detail hereinbelow, pivot member 108 will therefore have a right and a left embodiment. Additionally, both upper and lower sashes are supported by a pair of multi-coil spring assemblies 112, one on each side of the sash.

Figure 5:
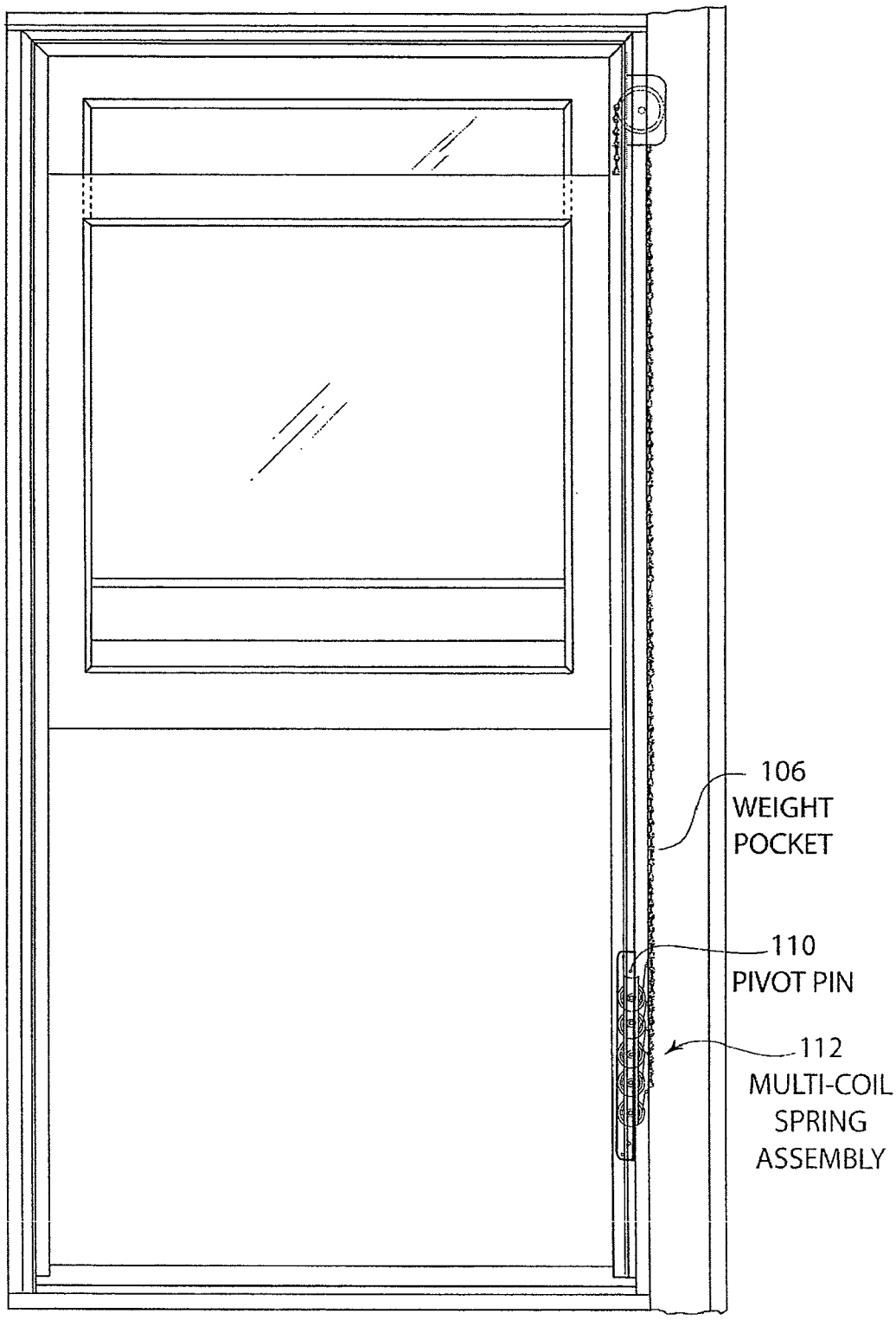
FIG. 5 is a schematic representation of a front cut-away view of the embodiment of the invention shown in FIG. 4 hereof further illustrating the attachment of multiple multi-coil springs to the connector, the pivot member/multi-coil spring assembly in its operating position out of the way of the sashes, and the lower sash in an open position.

FIG. 5 is a schematic representation of the front view of window 100 shown in FIG. 4 hereof, illustrating multi-coil spring assembly 112 in a retracted position in weight pocket 106 so that the multi-spring coil assembly is clear of the channel of the window frame in which the sash operates. Coil spring assembly 112 may pivot around pivot pin 110 to the retracted position. As will be described in detail hereinbelow, coil spring assembly 112 is prevented from retracting substantially beyond a vertical orientation in weight pocket 106, by use of a mounting block.

Figure 6:
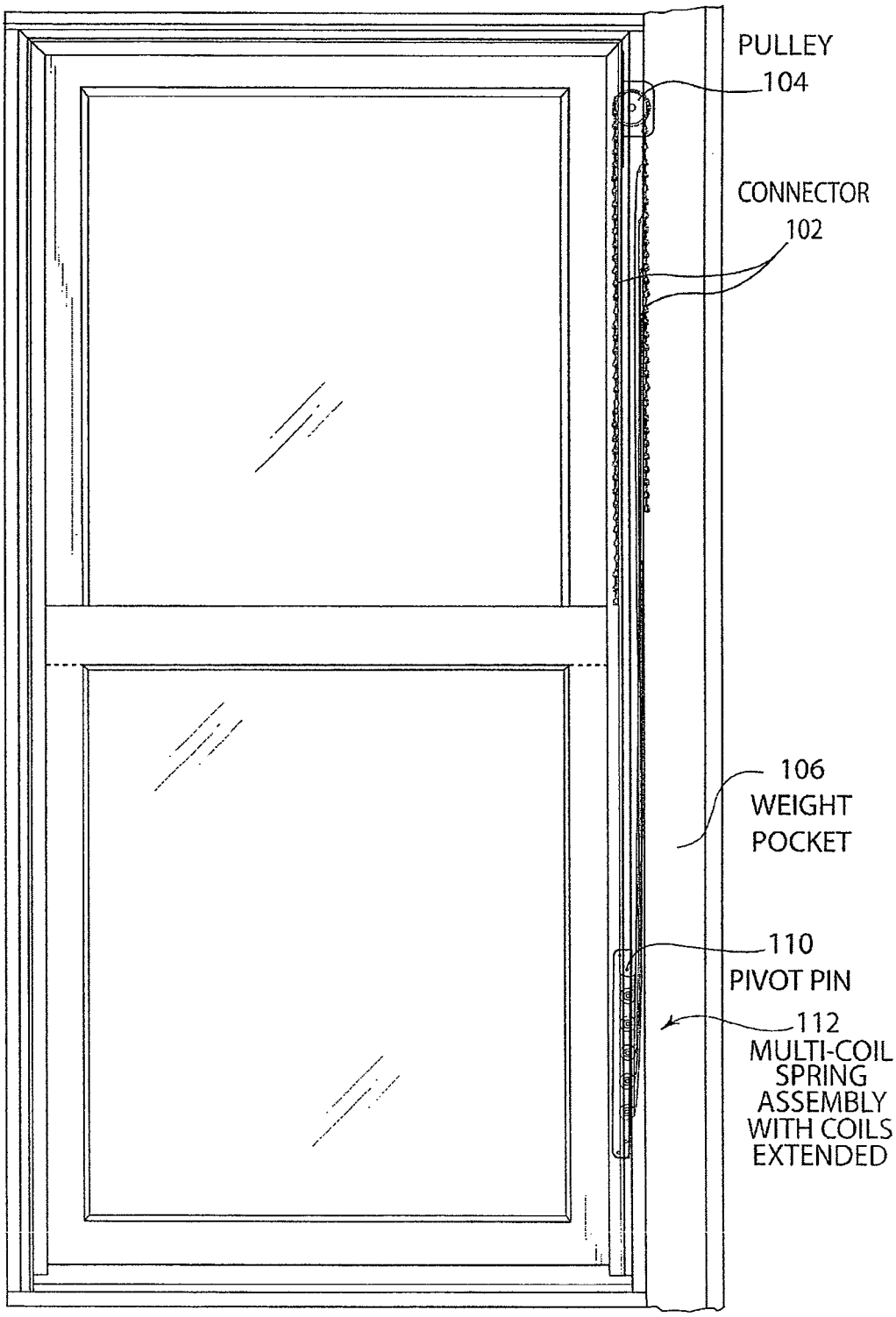
FIG. 6 is a schematic representation of a front cut-away view of the embodiment of the invention shown in FIG. 4 hereof further illustrating the attachment of multiple multi-coil springs to the connector, the pivot member/multi-coil spring assembly in its operating position out of the way of the sashes, and the lower sash closed.

FIG. 6 is a schematic representation of the front view of window 100 shown in FIG. 5 hereof, illustrating coil spring assembly 112 in a retracted position in weight pocket 106, and illustrating the window sash in a fully closed (down) position. As shown in FIG. 6, the multi-coil springs are extended and disposed substantially vertically in weight pocket 106, as connector 102 is pulled around the pulley by the downward movement of the window sash.

Figure 7A:
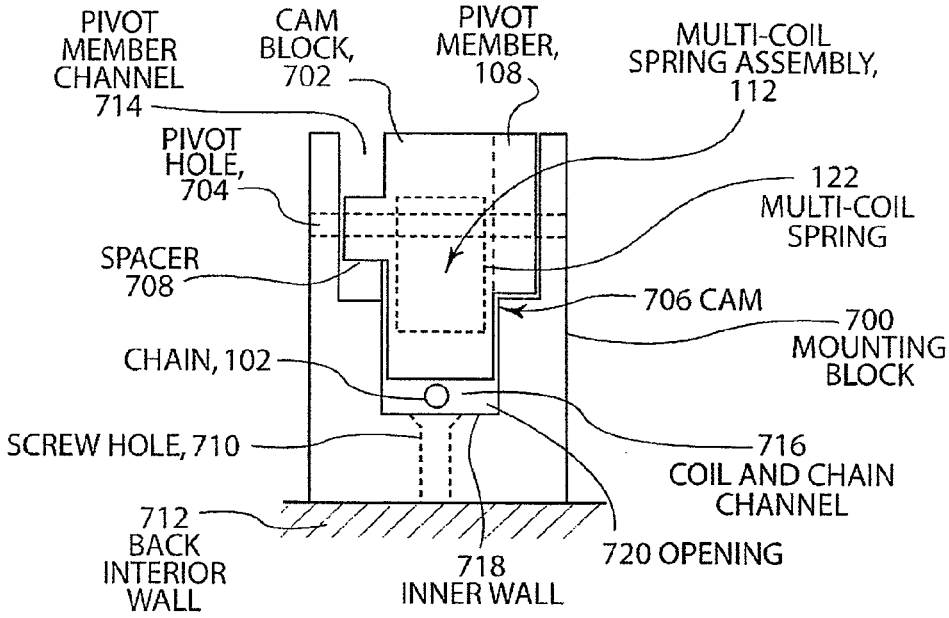

FIG. 7A is a schematic representation of the top view of mounting block or member, 700, for coil spring assembly 112 of the present invention. Shown are cam block, 702, having pivot hole, 704, therein, cam, 706, and spacer, 708. Mounting block or member 700 also has pivot hole 704 passing therethrough such that pivot member 108, cam block 702, cam 706 and spacer 708 can pivot about a pivot pin inserted in the pivot hole (not shown in FIG. 7A). The pivot member, the cam block, the cam, and the spacer may be formed from a single material, for example, plastic. Screw hole, 710, permits mounting block or member 700 to be securely attached to the vertical inner wall, 712, of weight pocket 106 in a straightforward manner. Shown also are pivot member channel, 714, coil and chain channel, 716, inner wall, 718, and opening, 720, in the top portion of mounting block or member 700.

Figure 7B:
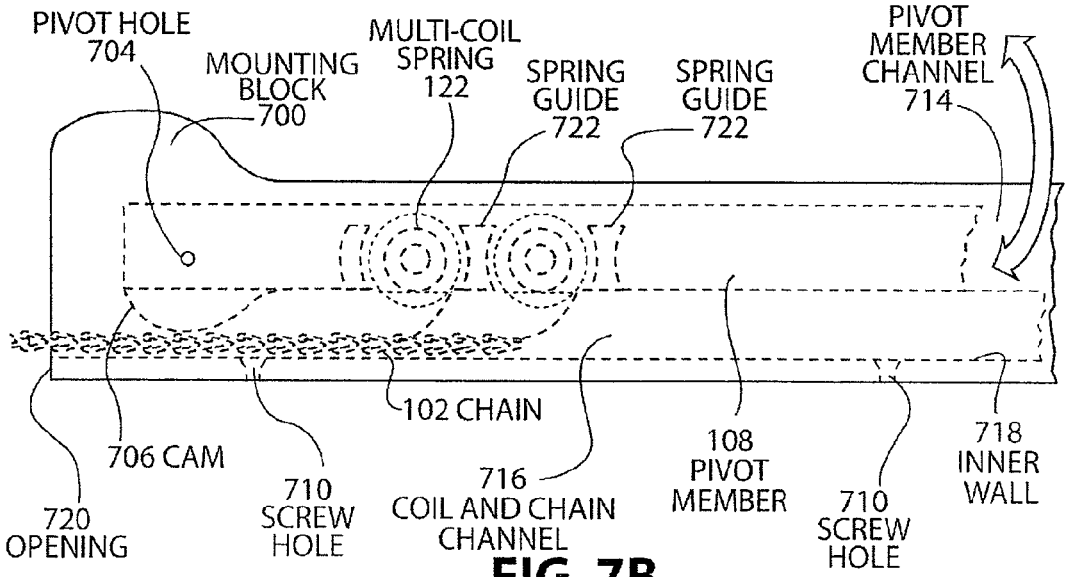
FIG. 7B illustrates a side view thereof.

FIG. 7B illustrates a schematic representation of a side view of the mounting block or member shown in FIG. 7A hereof. Cam 706 guides chain 102 along and the extended coil from multi-coil spring 122 such that they remain in the vicinity of inner wall 718, thereby preventing twisting of the chain and the extended coil as they pass through opening 720, in the top portion of mounting block or member 700. Shown also is multi-coil spring guide, 722, for preventing binding of the extended spring coil.

Figure 7C:
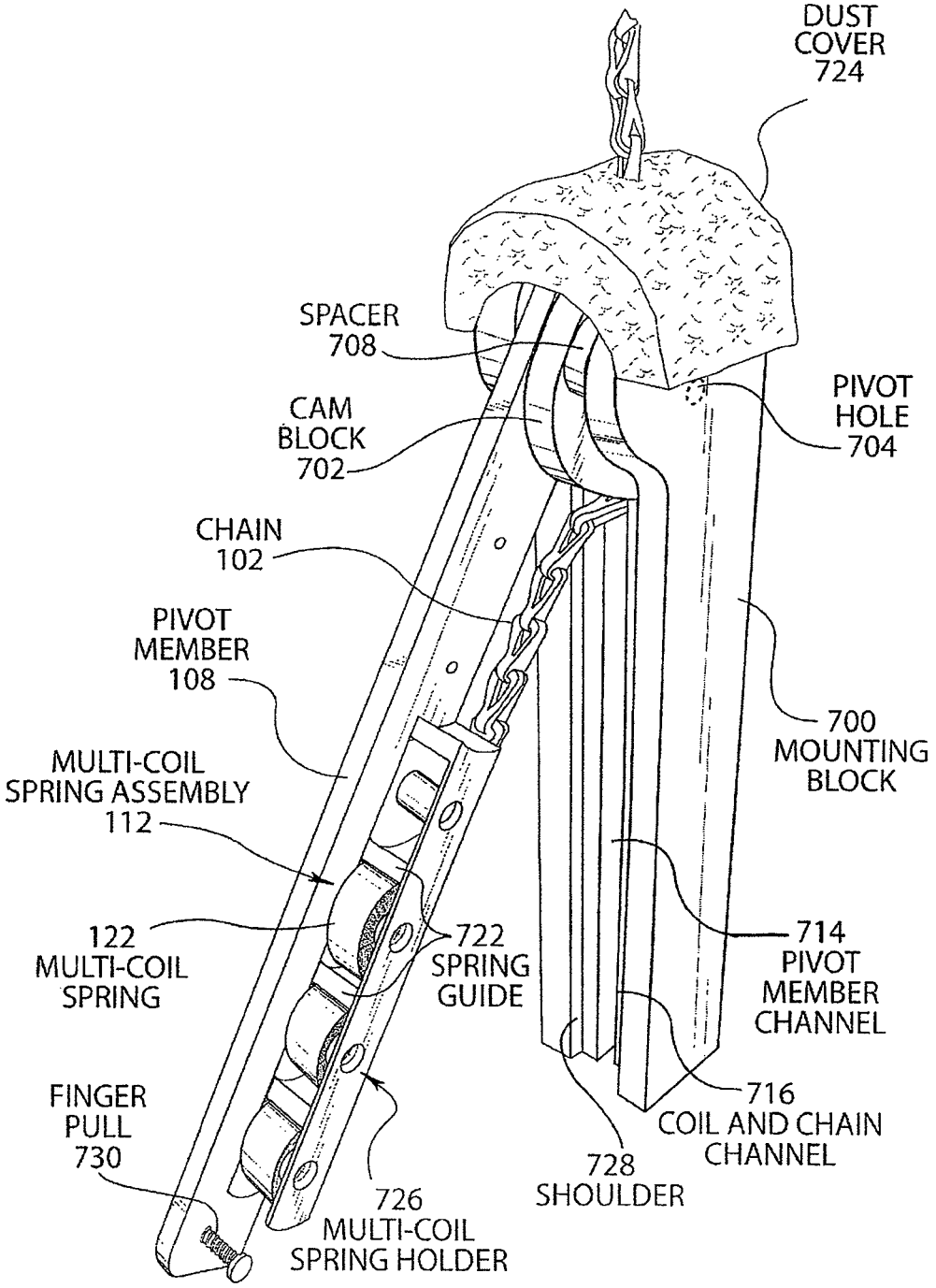
FIG. 7C is a schematic representation of a projection view of the mounting block and the multi-coil spring assembly shown in FIG. 7A hereof, further illustrating a dust-blocking cover.

FIG. 7C is a schematic representation of a projection view of mounting block or member 700 and the multi-coil spring assembly shown in FIG. 7A hereof, further illustrating dust blocking cover, 724, and spring holder, 726 which, as will be described in more detail hereinbelow, includes at least one spring guide 722. Pivot member 108 rests on outer channel shoulder, 728, when multi-coil spring assembly 112 is in its operating mode. Finger pull, 730, enables pivot member 108 to be easily pivoted for multi-coil spring adjustments, and returned to its operating position. It should be mentioned that FIG. 7C shows the right-hand embodiment of multi-coil spring assembly 112. A left-hand embodiment thereof (not shown in FIG. 7C hereof), permits an installer to have full access to the multi-coil springs (122 as an example), hook 200 and spring loop 124 (See FIG. 2 hereof) in order to attach an appropriate number of multi-coil springs to chains for multi-coil spring assemblies installed in weight pockets on the left-hand side of the window frame.

Figure 7D:
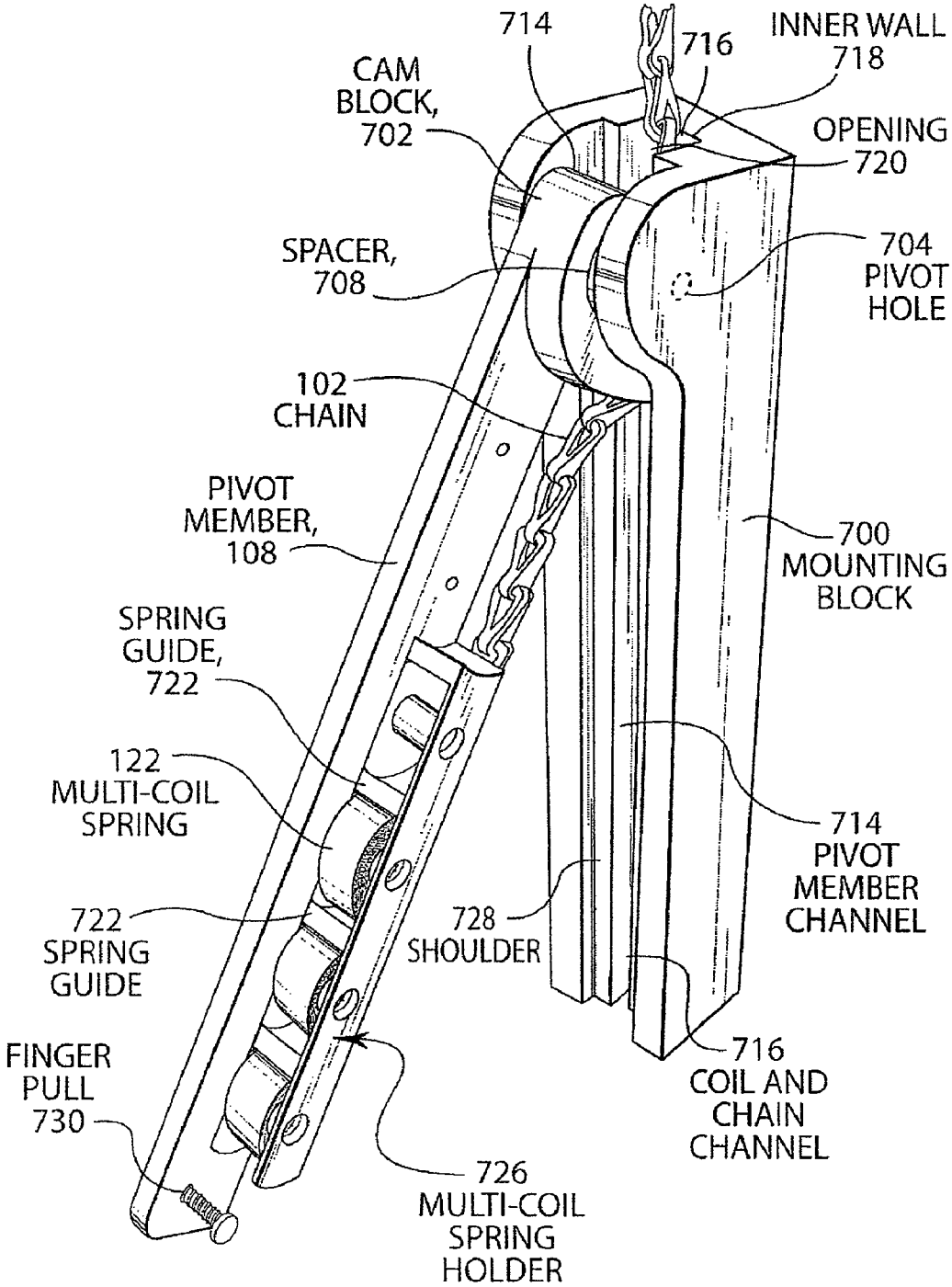

FIG. 7D is another schematic representation of a projection view of the mounting block and the multi-coil spring assembly shown in FIG. 7C hereof, further illustrating pivot member channel 714, coil and chain channel 716, inner wall 718, and opening 720.

Figure 7E:
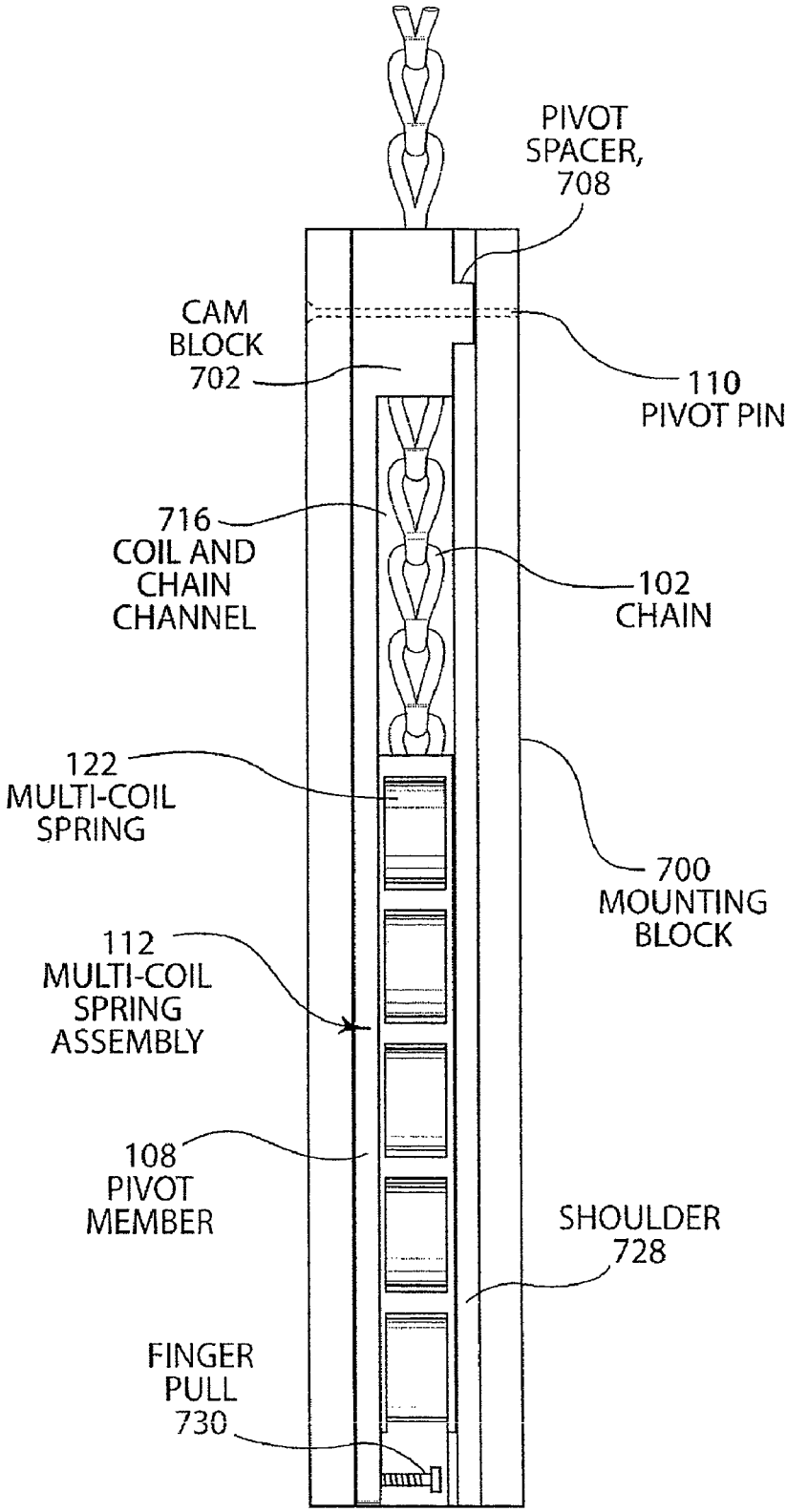
FIG. 7E is a schematic representation of the front view of the mounting block and pivot member/multi-coil spring assembly shown in FIG. 7C hereof.

FIG. 7E is a schematic representation of the front view of the mounting block or member and coil spring assembly shown in FIG. 7C hereof. This is also the view of the coil spring assembly as would be obtained by viewing the window jamb in the vicinity of the opening in weight pocket 106.

Figure 8:
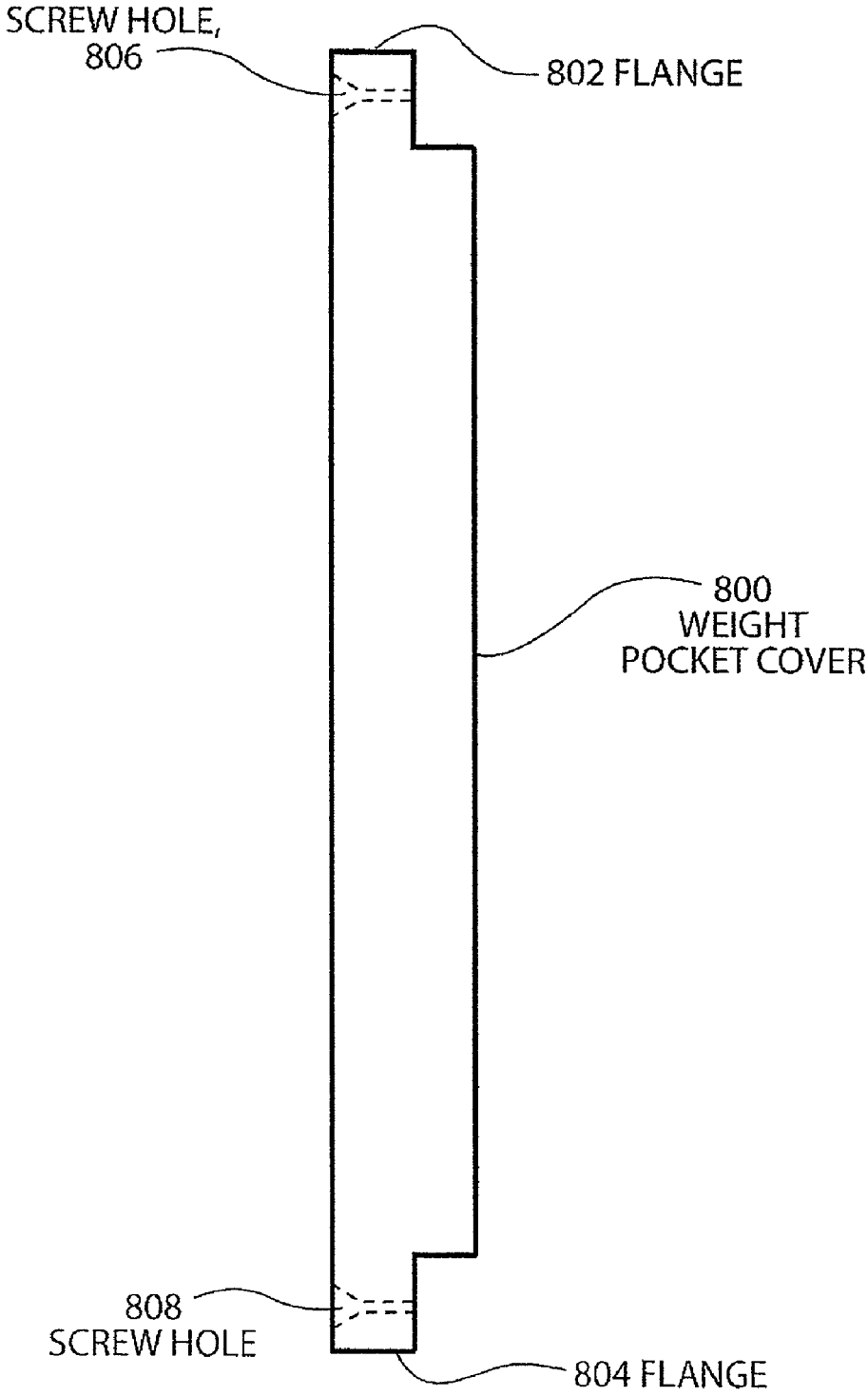
FIG. 8 is a side view of the weight pocket cover.
Figure 9:
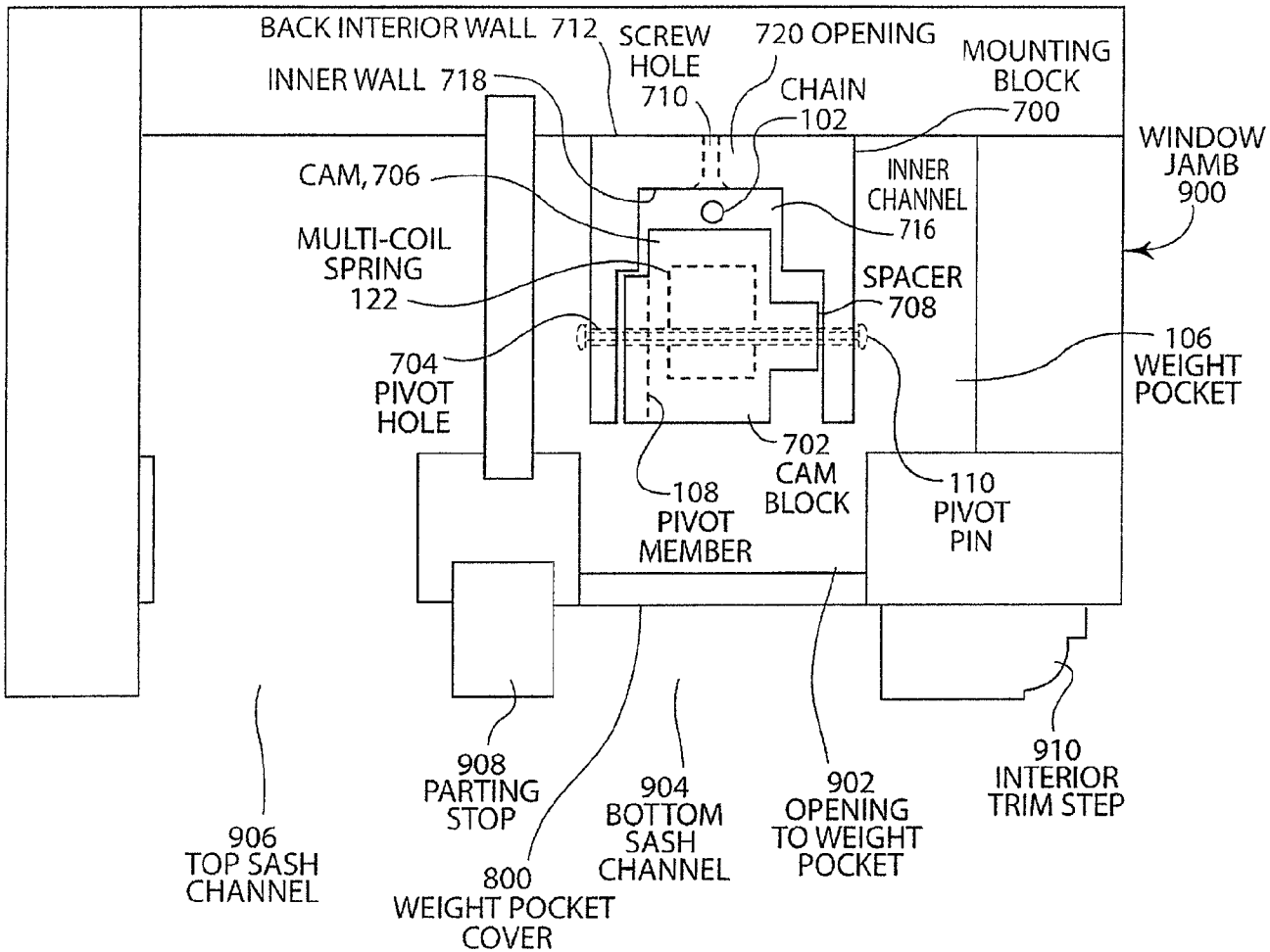
FIG. 9 is a schematic representation of a top sectional view of the right window jamb, illustrating the manner in which the mounting block and pivot member/multi-coil spring assembly is mounted in the weight pocket of the window frame.

FIG. 8 is a side view of weight pocket cover, 800. Flanges 802 and 804 fit into the recessed portions of the opening of weight pocket 106 in window jamb, 900, (FIG. 9 hereof). The flanges permit cover 800 to be made thicker without protruding into bottom sash channel 904 (FIG. 9 hereof). However, cover 800 may also be made without flanges if the extra thickness is not required. Screw holes, 806 and 808, permit screws to be used, as an example, for attaching weight pocket cover 800 to the interior of window frame 126.

FIG. 9 is a schematic representation of a top sectional view of right window jamb, 900, illustrating the manner in which mounting block 700 is mounted in weight pocket 106 of the window frame. Cover 800 covers opening, 902, of weight pocket 106 in the window jamb, providing a flush surface for mounting weather stripping, thereby forming a portion of channel, 904, wherein the bottom sash (not shown in FIG. 9) may smoothly slide in the window frame. FIG. 9 also shows top sash channel, 906, wherein another mounting block or member and coil spring assembly would be mounted to counterbalance the top sash (not shown in FIG. 9) in accordance with the teachings of the present invention. Disposed between bottom sash channel 904 and the top sash channel 906 is a parting stop, 908. Interior trim stop, 910, forms the other vertical portion of the bottom sash channel 904. As shown in FIG. 9, the bottom sash (not shown in FIG. 9) moves up and down in bottom sash channel 904 in a direction perpendicular to the surface of FIG. 9.

Mounting block or member 700 is affixed using screws inserted through screw holes (only screw hole 710 is shown in FIG. 9) to back interior vertical wall 712 such that pivot member 108 bearing coil spring 122 and, as needed other coil springs, can rotate out of opening 902 of weight pocket 106 passed bottom sash channel 904, and into the interior portion of the window for ready accessibility for connection of coil spring assembly 112 to chain 102, as shown in FIGS. 1-4 hereof. Coil spring assembly 112, including pivot member 108, are pivotably mounted in mounting block 700 by pivot pin 110 are recessed within opening 902 of weight pocket 106 during normal operation of the sash as shown in FIG. 5, hereof.

Figure 10A:
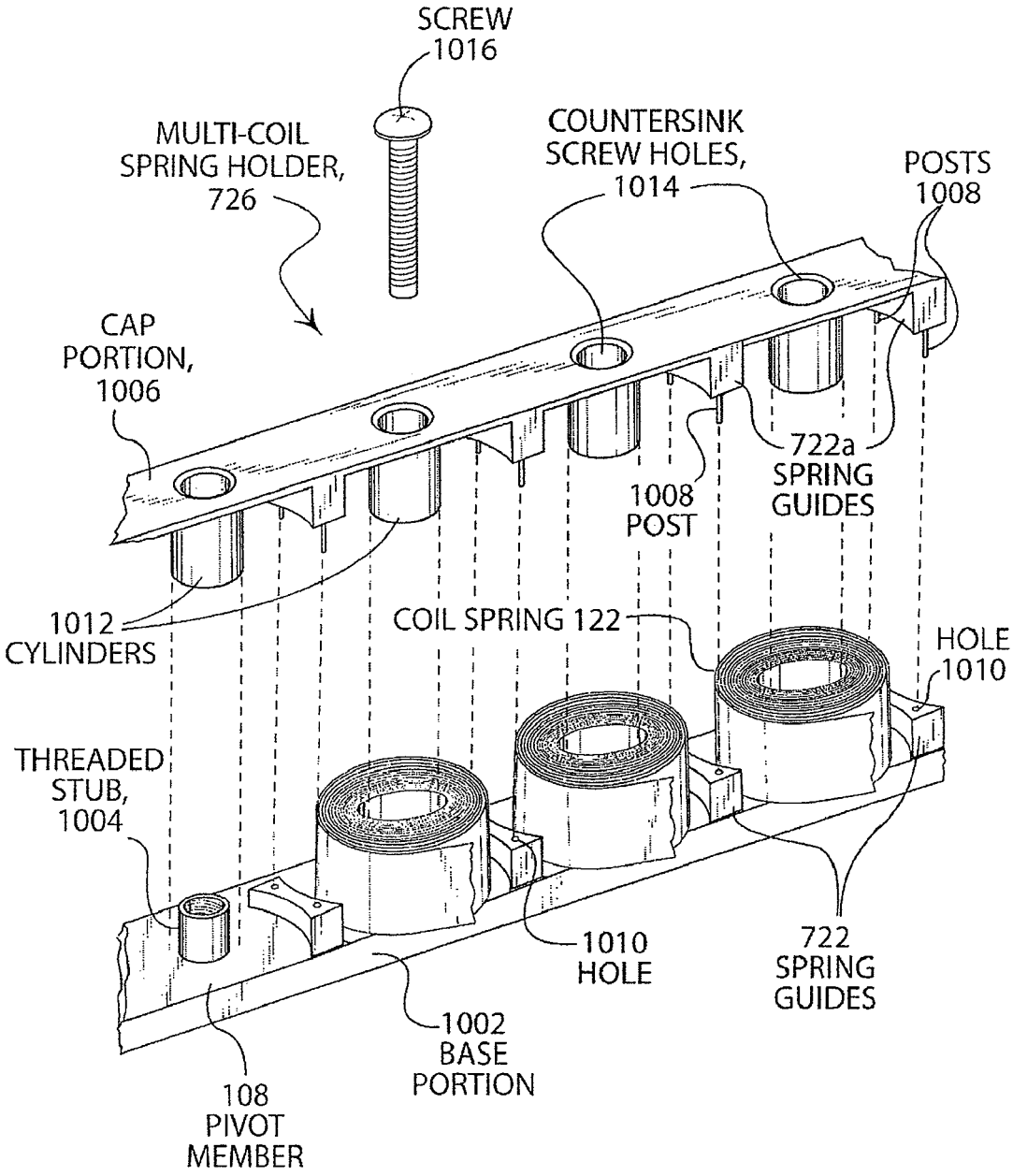
Figure 10B:
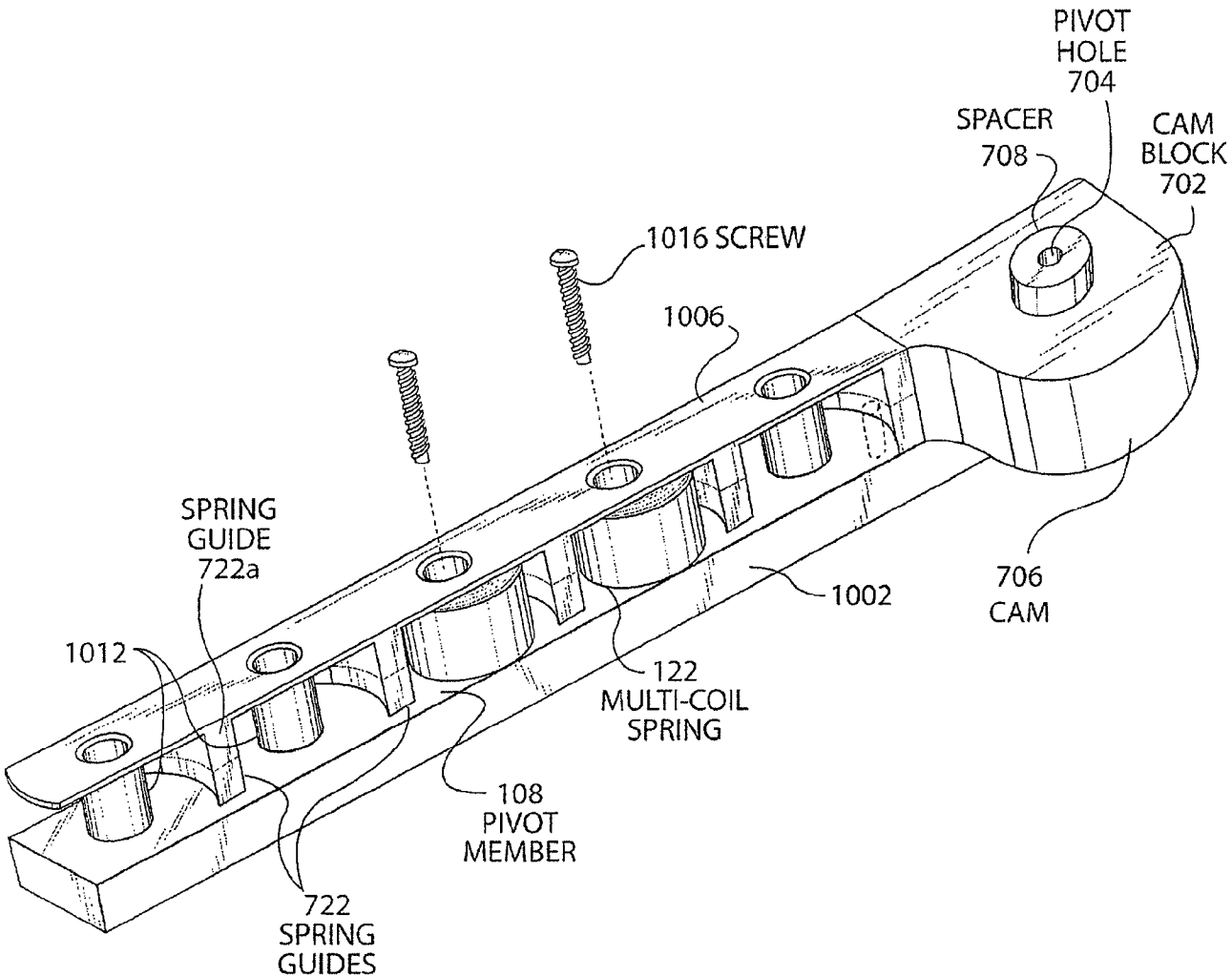
FIG. 10B is a schematic representation of the assembled multi-coil spring holder illustrated in FIG. 10A hereof.

FIG. 10A is a schematic representation of an exploded view of one embodiment of coil spring holder 726 of coil spring assembly 112 of the present invention, while FIG. 10B is a schematic representation of the assembled multi-coil spring holder illustrated in FIG. 10A hereof. Base portion, 1002, may be fabricated onto and forms a part of pivot member 108. Base portion 1002 includes coil spring guides 722 and threaded stubs, 1004. Cap portion, 1006, includes matching coil spring guides, 722*a*, which may have posts, 1008, which fit into matching holes, 1010, for added stability of the assembled structure. Cylinders, 1012, having countersunk screw holes, 1014 may fit over threaded stubs 1004 for added stability and, together with coil spring guides 722 stabilize the multi-coil springs 122, etc., in the assembled unit. Screws, 1016, hold cap portion 1006 and base portion 1002 together.

Figure 10C:
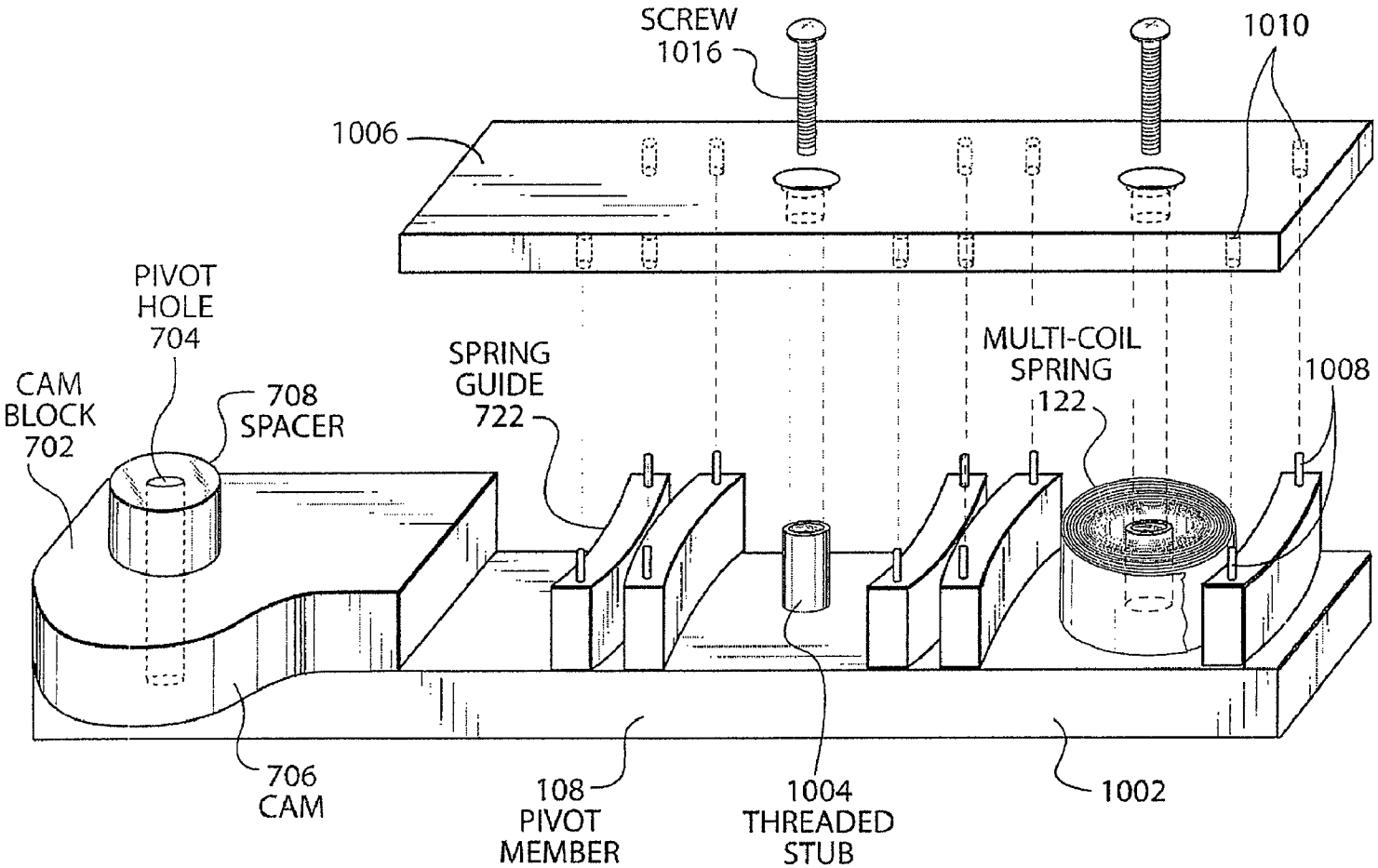
FIGS. 10C and 10D are schematic representations of exploded views of two further embodiments of the multi-coil spring holder of the present invention.
Figure 10D:
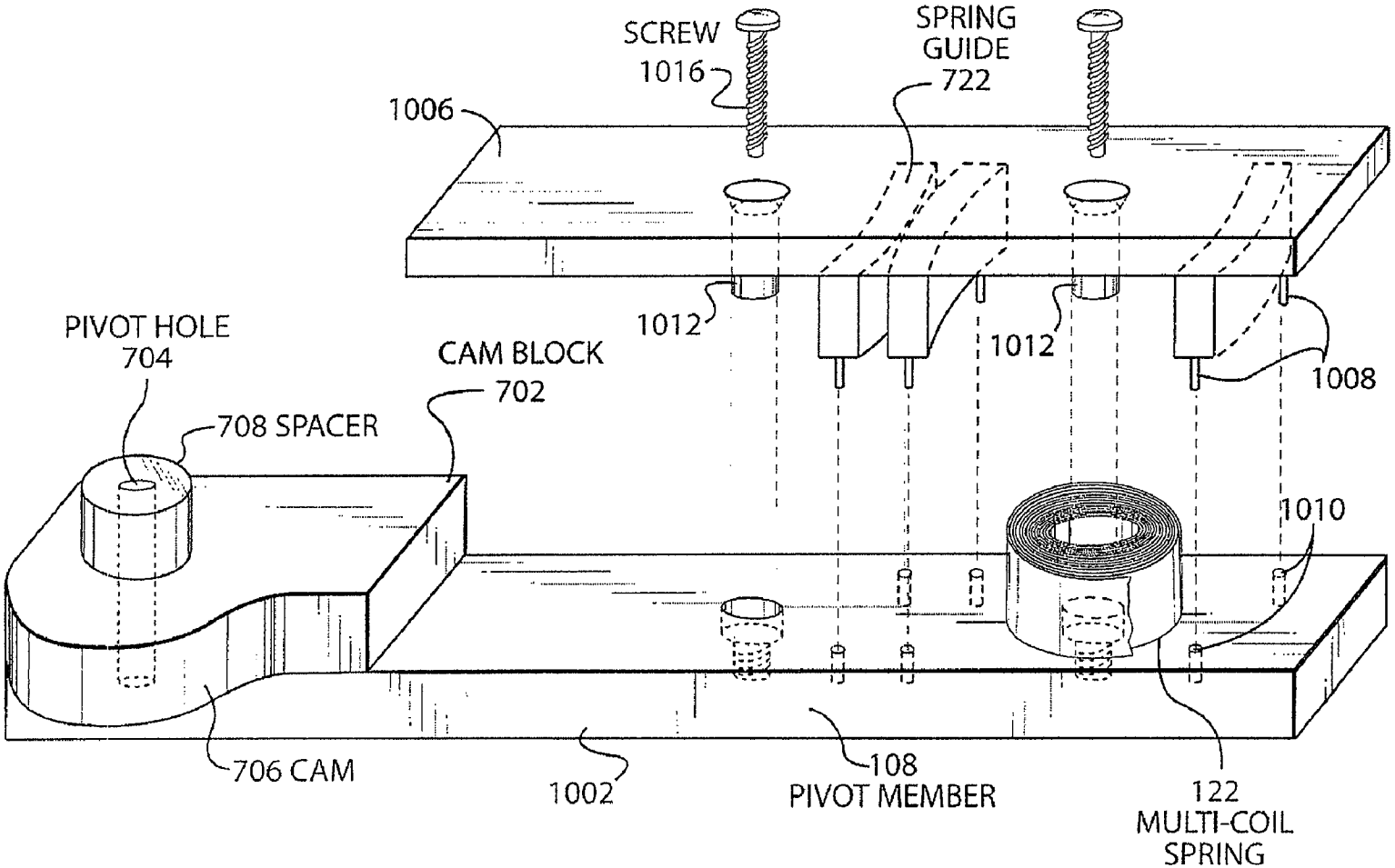

FIGS. 10C and 10D are schematic representations of exploded views of two additional embodiments of the pivot member/coil spring assembly of the present invention. Coil spring guide members 722 are formed as a single unit on base portion 1002 or on cap portion 1006 in FIG. 10C and FIG. 10D, respectively.

Figure 10E:
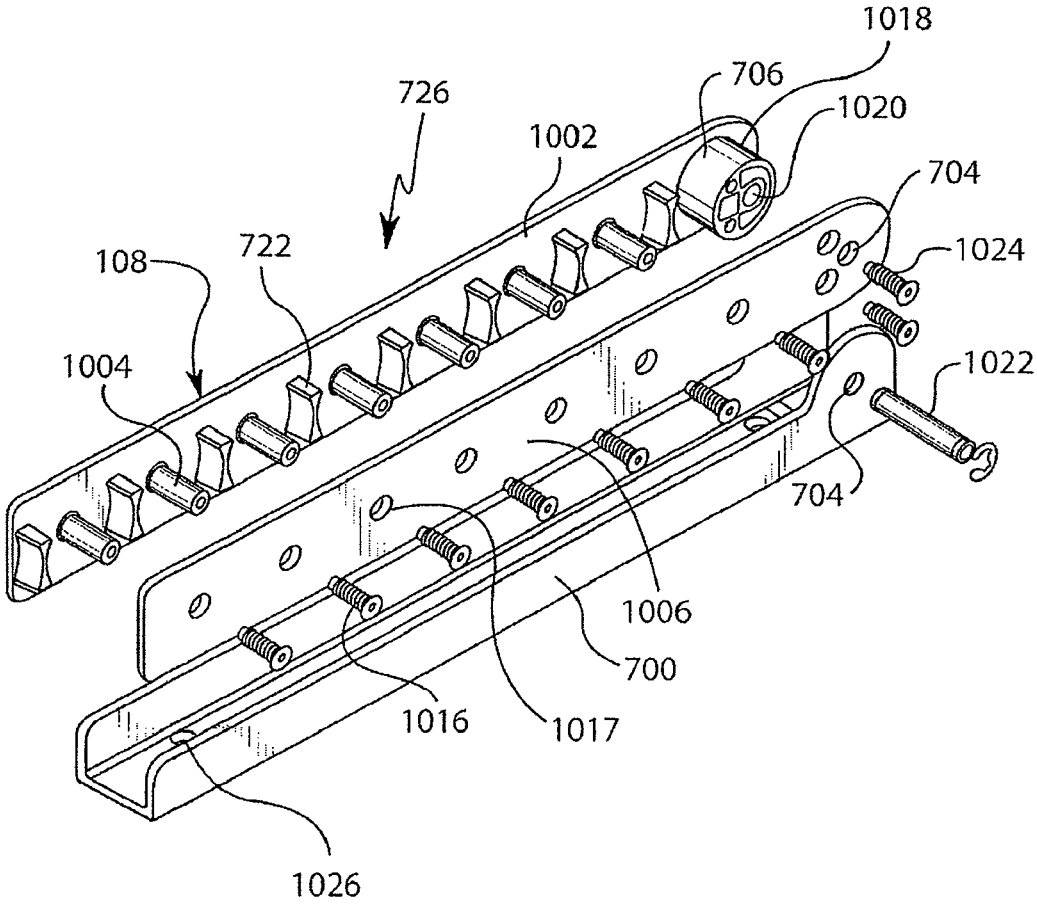
FIGS. 10E and 10F are a perspective exploded view and a perspective assembled view, respectively, of another embodiment thereof, without the coil springs and counterbalance connector, for purposes of clarity.
Figure 10F:
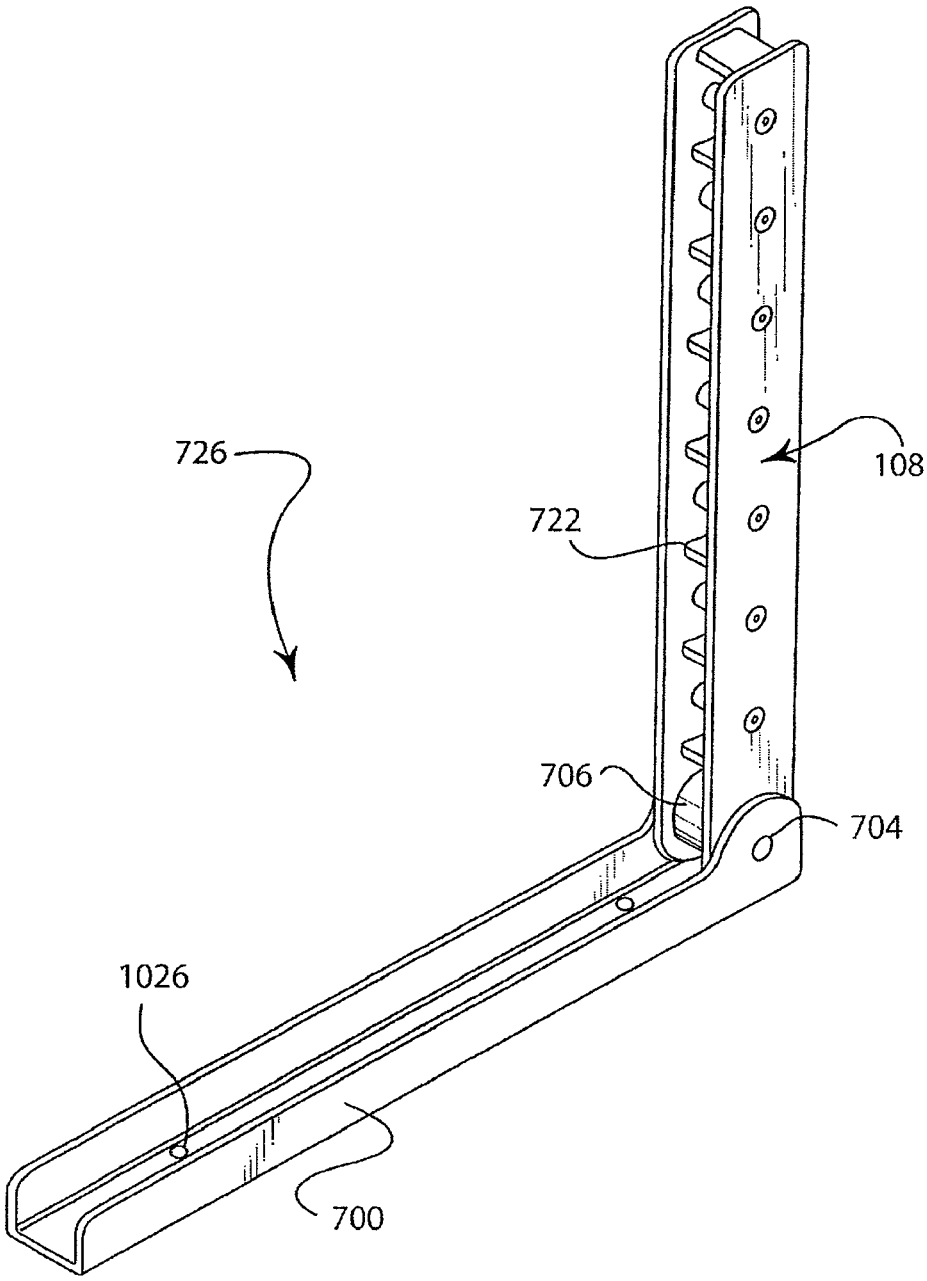

FIGS. 10E and 1OF are perspective views of an exploded and an assembled view, respectively, of another embodiment of coil spring counterbalance 726 without the coil springs, and the counterbalance connector for purposes of clarity. In this embodiment, cap portion 1006 of pivot member 108 has countersunk holes, 1017, adapted to receive the heads of screws 1016. Coil spring guide members 722 are shown formed or mounted on base 1002. Cam 706 is formed by cylindrical member, 1018, having an offset hole, 1020, therein for receiving pivot pin, 1022, which also passes through pivot hole 704 in counterbalance 726. Screws, 1024, attach cylindrical member 1018 to cap portion 1006. Open channel-shaped mounting member 700, having mounting holes, 1026, is adapted to pivotably receive pivot member 108, and may readily be mounted in the weight pocket of a window frame if a window sash counterbalance is the intended use of counterbalance 726. Mounting member 700 may be fabricated from metal or plastic, as examples.

The foregoing description of the invention has been presented for purposes of illustration and description and is not intended to be exhaustive or to limit the invention to the precise form disclosed, and obviously many modifications and variations are possible in light of the above teaching. For example, in FIG. 2, spring loop 124 of each coil 122 may be formed such that the end of each coil spring may be connected directly to chain 102, thereby eliminating the use of hook 200. In addition, if other types of connectors are used, such as bands or ribbons, other ways of connecting the spring directly to the band or ribbon may be used. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A method for counterbalancing at least a portion of the weight of a vertically movable member, comprising:

mounting at least one coil spring on a pivot member such that each of the at least one coil springs generates a chosen force when uncoiled from the pivot member;

pivotably mounting the pivot member in a mounting member having an open channel, thereby permitting the at least one coil spring to be readily accessed; and attaching a chosen number of the at least one coil springs to a counterbalance connector such that a selected force is exerted on the counterbalance connector; and attaching the counterbalance connector to the vertically movable member, such that at least a portion of the weight of the vertically movable member is offset.

2. The method of claim 1, wherein each of the at least one coil springs generates a constant chosen force.

3. The method of claim 1 further comprising the step of selecting a chosen force constant for each of the at least one spring coils, and the number of at least one multi-coil springs to generate a selected force.

4. The method of claim 3, further comprising the step of attaching the selected combination of force constants and the number of the at least one spring coil springs to the counterbalance connector to generate a desired offset of at least a chosen portion of the weight of the vertically movable member.

5. The method of claim 1, wherein the vertically moving member is chosen from windows, doors, and garage doors.

* * * * *